United States Patent [19]

Lash

[11] Patent Number: 4,514,267

[45] Date of Patent: Apr. 30, 1985

[54] ZINC ELECTROPLATING ADDITIVE CONCENTRATE

[75] Inventor: Ronald J. Lash, Rochester, Mich.

[73] Assignee: OMI International Corporation, Warren, Mich.

[21] Appl. No.: 606,464

[22] Filed: May 7, 1984

[51] Int. Cl.[3] ..... C25D 3/22; C25D 3/56

[52] U.S. Cl. ..... 204/44.2; 204/55 R; 204/DIG. 2

[58] Field of Search ..... 204/55 R, 44.2, DIG. 2, 204/114

[56] References Cited

U.S. PATENT DOCUMENTS 4,229,268 10/1980 Lowery et al. ..... 204/55 R 4,422,908 12/1983 Welch ..... 204/55 R

*Primary Examiner*—G. L. Kaplan

*Attorney, Agent, or Firm*—Richard P. Mueller

[57] ABSTRACT

An aqueous concentrate adapted for dilution with water for use in the make-up and replenishment of zinc or zinc alloy electroplating baths of the chloride and the mixed chloride types comprising an aqueous solution containing zinc chloride in an amount of about 10 to about 400 g/l, a hydrophobic organic brightening agent selected from the group consisting of aryl aldehydes, halo aryl aldehydes, aryl alkenyl ketones, aryl alkenyl aldehydes, heterocyclic alkenyl ketones and aldehydes as well as mixtures thereof generally present in an amount of about 10 up to about 200 g/l and a solubilizing agent comprising an alkyl phenyl sulfonate compound present in an amount of at least about 10 g/l up to an amount in consideration of the concentration of the zinc chloride and organic brightening agent present in the concentrate.

8 Claims, No Drawings

ZINC ELECTROPLATING ADDITIVE CONCENTRATE

BACKGROUND OF THE INVENTION

The present invention broadly relates to zinc electroplating additive compositions and processes, and more particularly, to a stable aqueous concentrate containing hydrophobic brightening agents adapted for dilution with water for the make-up and replenishment of acid zinc or zinc alloy electroplating baths of the chloride and mixed chloride types.

It is conventional commercial practice to employ liquid concentrates of additive agents adapted for the make-up and replenishment of electroplating baths. Such additive agents are preferably provided in the form of an aqueous solution which can subsequently be diluted with water to form an electroplating bath containing the essential constituents within a preferred range. Similarly, a replenishment of the essential bath constituents is preferably performed employing such aqueous concentrates which are periodically and/or continuously added to the bath through liquid metering pumps as a function of the ampere-hour usage of the bath as being indicative of the consumption of certain of such ingredients. Acid zinc or zinc alloy electroplating baths of the types presently in widespread commercial use, employ various organic brightening agents to enhance the brightness, leveling and ductility of the zinc or zinc alloy deposit. Many of such organic primary brightening agents because of their hydrophobic nature are not readily soluble in water necessitating the use of organic solvents, organic hydrotropes and/or organic dispersing agents to prepare liquid concentrates of such additives for make-up and replenishment of acid zinc or zinc alloy electrolytes. The necessity of employing relatively large quantities of such supplemental solvents and dispersing agents substantially increases the cost of such concentrates and also imposes shipping restrictions due to the presence of solvents which are of a flammable nature. The presence of such supplemental organic dispersing agents in the liquid concentrates also constitutes a source of contamination of the electroplating bath frequently resulting in an undesirable lowering of the bath cloud point. In spite of the use of such supplemental organic agents in such concentrates for solubilizing the hydrophobic organic brightening agents, undesirable precipitates are formed when such concentrates are exposed to relatively low ambient temperatures such as encountered during shipment and storage in northern climates during the winter months. Under such conditions, precipitates are formed at relatively moderate temperatures which have been found cannot be redissolved when the concentrate is reheated to room temperature. The foregoing problem requires special shipping and storage conditions to prevent a "freezing out" of the hydrophobic organic brightener additives in such concentrates and in some instances, necessitates a discarding of such concentrate when appreciable quantities of insoluble precipitate have formed.

The present invention overcomes many of the problems and disadvantages associated with aqueous concentrates of the types heretofore known which completely or substantially completely eliminates the use of expensive flammable solvents, which substantially increases the stability of such concentrates even when subjected to relatively cool temperatures, which facilitates a dissolution of any precipitates formed by simply reheating the concentrate in the presence of agitation, and which does not introduce detrimental contaminants into the zinc electroplating bath.

SUMMARY OF THE INVENTION

The benefits and advantages of the present invention are achieved by an aqueous additive concentrate adapted for use in the make-up and replenishment of zinc electroplating baths of the chloride and mixed chloride types containing as essential constituents, zinc chloride, a hydrophobic organic brightening agent, and a solubilizing agent with the balance comprising water. The zinc chloride in the addition agent concentrate may be present in an amount of about 10 up to about 400 grams per liter (g/l); the hydrophobic organic brightening agent is one selected from the group consisting of aryl aldehydes, halo aryl aldehydes, aryl alkenyl ketones, aryl alkenyl aldehydes, heterocyclic alkenyl ketones, heterocyclic alkenyl aldehydes as well as mixtures thereof usually present in an amount of about 10 to about 200 grams per liter; a solubilizing agent comprising an alkyl phenyl sulfonate compound as well as the bath soluble and compatible salts thereof in which the solubilizing agent is present in an amount of at least about 10 g/l up to an amount in combination with the zinc chloride constituent to provide a combined concentration of zinc chloride and solubilizing agent ranging from about 270 up to about 570 g/l for each 100 g/l or fraction thereof of the brightening agent present in the concentrate. The balance of the concentrate comprises water and may optionally further include compatible additive agents of the types conventionally employed in zinc electroplating baths.

Additional benefits and advantages of the present invention will become apparent upon a reading of the Description of the Preferred Embodiments taken in conjunction with the specific examples provided.

DESCRIPTION OF THE PREFERRED EMBODIMENTS

The aqueous concentrate of the present invention containing hydrophobic organic primary brighteners is broadly applicable for make-up and replenishment of aqueous acidic zinc electrolytes of the chloride and mixed chloride types as well as such acid electrolytes further incorporating controlled amounts of nickel and/or cobalt ions for effecting the electrodeposition of a zinc alloy containing the foregoing alloying metals in small amounts. Conventionally, such aqueous acidic electrolytes contain zinc ions present in an amount effective to electrodeposit zinc with amounts broadly ranging from about 5 g/l up to saturation being usable. Typically, such acid chloride and mixed chloride electrolytes contain zinc ions within a range of about 7 up to about 50 g/l. When a zinc alloy electrodeposit is desired, the aqueous acidic electrolyte further contains an effective amount of alloying metal ions such as nickel, cobalt and mixtures thereof which are controlled in concentration to provide the desired percentage of alloying metal or metals in the electrodeposit. Typically, zinc-cobalt alloy deposits contain about 0.05 percent up to about 5 percent by weight cobalt while zinc-nickel alloy deposits generally contain about 0.05 up to about 20 percent by weight nickel. The nickel ions are introduced in the form of a bath soluble and compatible nickel salt to provide a nickel ion concentration usually ranging from about 1 to about 60 g/l. Similarly, cobalt ions are introduced in the form of a bath soluble and compatible salt to generally provide a cobalt ion concentration of about 1 to about 40 g/l. The mixed chloride-type electrolytes may be mixtures of chloride with sulfate, sulfamate, fluoborate and acetate.

In accordance with conventional practice, such aqueous acidic electrolytes further contain inert salts to increase the electrical conductivity of the electrolyte and such salts are usually employed in amounts of about 20 up to about 450 g/l. The inert salts generally comprise magnesium and alkali metal chlorides including sodium, potassium, lithium as well as ammonium salts. Sodium and potassium chloride are most typical.

The aqueous electrolyte further incorporates, in accordance with conventional practice, boric acid typically present in an amount up to about 35 g/l and hydrogen ions to provide a pH on the acid side, broadly from about pH 1 up to about 6.5 and more typically, a pH of about 4.5 up to about 6.2.

In accordance with conventional practice, the electrolyte further contains a primary brightener or combination of primary brightening agents in concentrations ranging from about 0.001 up to about 10 g/l with concentrations of about 0.01 up to about 5 g/l being more typical. Optionally, the electrolyte can further contain supplemental or secondary brightening agents of the types conventionally employed in such acid chloride and mixed chloride non-cyanide electrolytes. Supplemental brightening agents of the types well-known in the art can be employed in amounts up to about 10 g/l with amounts of about 0.2 up to about 5 g/l being preferred. Typical of such secondary brightening agents are polyethers, aromatic carboxylic acids and their bath soluble salts, nicotinate quaternary compounds and the like which when used, are generally employed in the form of a mixture of two or more in combination with a primary brightening agent in order to attain the desired brightness of the zinc or zinc alloy electrodeposit.

The aqueous concentrate of the present invention serves the function of introducing a hydrophobic primary brightening agent into an operating bath to effect replenishment of this constituent thereby maintaining the bath within appropriate operating concentrations as well as for make-up of such an electrolyte by dilution with water. Primary organic brightening agents of a hydrophobic nature which are desirably included in such zinc and zinc alloy electrolytes are selected from the group consisting of aryl aldehydes, halo aryl aldehydes, aryl alkenyl ketones, aryl alkenyl aldehydes, heterocyclic alkenyl ketones, heterocyclic alkenyl aldehydes as well as mixtures thereof. Typical of such hydrophobic organic brightening agents of the foregoing classes are benzylidene acetone, cinnamaldehyde, 4-phenyl-3-butyne-2-one, benzaldehyde, orthochlorobenzaldehyde, orthobromobenzaldehyde, difluorobenzaldehyde, furfural acetone, 1-(3-pyridyl)-1-buten-3-one, anisaldehyde, vanillin, piperonal, 1-phenyl hexa-1,3-diene-5-one, 1-thiophene 2-buten-3-one, and the like.

The heterocyclic alkenyl ketones and aldehydes employed as primary brightening agents contain an unsaturated five or six membered ring having one nitrogen, oxygen or sulfur atom in the ring. The alkenyl substituent contains from two to six carbon atoms and the unsaturated bond is in conjunction with the aryl or heterocyclic group.

The present invention is based on the discovery that such hydrophobic primary organic brightening agents can be solubilized in the form of an aqueous concentrate which is substantially stable by the incorporation in the concentrate of controlled amounts of zinc chloride in combination with an alkyl phenyl sulfonate compound serving as a solubilizing agent. Both the zinc chloride and alkyl phenyl sulfonate compound are present in the concentrate in an amount of at least about 10 g/l and the total weight of these two constituents will vary depending upon the quantity of the hydrophobic organic brightening agent present in the concentrate. It has been found by experimentation that the sum of the zinc chloride and solubilizing agent should range from about 270 g/l up to about 570 g/l for each 100 g/l or fraction thereof of said hydrophobic brightening agent present in the concentrate. The zinc chloride constituent can generally range from at least about 10 up to about 400 g/l with concentrations of about 100 to about 200 g/l being preferred and with a concentration of about 150 g/l being typical.

The hydrophobic organic brightening agent can be present in the concentrate in an amount of as low as about 10 g/l up to about 200 g/l with concentrations of about 75 to about 100 g/l being typical and preferred for commercial practice.

The alkyl phenyl sulfonate solubilizing agent is selected from a class of compounds in which the sulfonate group ($SO_3$) is connected directly to the phenyl ring and the compound may contain one or two such sulfonate groups. The alkyl group may range from 1 up to 6 carbon atoms and from 1 up to 3 alkyl groups can be connected to the phenyl ring. When more than 1 alkyl group is present, the total carbon atom content of such substituent groups is controlled to provide satisfactory solubility in further consideration of the number of sulfonate groups in the compound. It will be appreciated that mixtures of the foregoing alkyl phenyl sulfonate compounds can also be satisfactorily employed.

While the aqueous concentrate as hereinabove described contains zinc chloride, the hydrophobic organic brightening agent or mixtures thereof and the solubilizing agent as its essential constituents in combination with water, it will be appreciated that additional ingredients can further be incorporated in the concentrate which do not adversely affect its stability and which are compatible with the remaining constituents present. For example, appropriate amounts of supplemental or secondary brightening agents can also be included to replenish this constituent in the operating electrolyte. Ordinarily, such supplemental brightening agents and other bath additives are added to the electrolyte by separate additions.

It is also contemplated that the concentrate can contain a small proportion of solvent introduced in the form of a solution of the hydrophobic organic brightening agent to facilitate its admixture in the solution. In the practice of the present invention, it is not necessary that the hydrophobic organic brightening agent be first solubilized in such a solvent and the brightener can be directly added to the aqueous concentrate solution in the presence of agitation to effect a dissolving thereof as hereinafter more fully described in the examples provided.

In the operation of the zinc or zinc alloy electrolyte, replenishment of the major portion of zinc ions is achieved by a progressive dissolution of zinc anodes employed in the bath. Further replenishment of such zinc ions is achieved by the addition of the brightener concentrate containing zinc chloride which also serves to replenish a portion of the chloride ions which are depleted during bath operation as a result of drag-out. The alkyl phenyl sulfonate compound in the concentrate does not adversely affect the operation of the acid zinc or zinc alloy electrolyte in in some instances, contributes to an improved zinc or zinc alloy electrodeposit.

In order to further illustrate the present invention, the following examples are provided. It will be understood that the examples are provided for illustrative purposes and are not intended to be limiting of the scope of the present invention as herein described and as set forth in the subjoined claims.

EXAMPLE 1

An aqueous additive concentrate suitable for the make-up and replenishment of acid zinc electrolytes of the chloride containing types is prepared by dissolving 300 g/l of zinc chloride in ½ liter of water. Thereafter, 225 g/l of isopropyl benzene sulfonate sodium salt is added and dissolved followed by the addition of 60 g/l of orthochlorobenzaldehyde and 32 g/l of benzylidene acetone in the presence of agitation. The resultant concentrate is further diluted with water to provide a volume totalling 1 liter.

The aqueous concentrate solution at room temperature is clear and can be cooled down to about 38° F. without any crystal or precipitate formation. Upon further cooling below about 38° F., some crystal formation is observed. However, upon reheating the solution to a temperature of about 51° F. in the presence of agitation, the crystalline precipitate is redissolved again providing a clear, commercially acceptable solution.

EXAMPLE 2

An aqueous concentrate is prepared employing the procedure as set forth in Example 1 by dissolving 75 g/l of zinc chloride in about ½ liter of water followed by the addition and dissolution of 203 g/l cumene sulfonate potassium salt. Thereafter, 60 g/l of dichlorobenzaldehyde is added in the presence of agitation and dissolved. The concentrate is diluted with additional water to provide a total volume of 1 liter. The aqueous concentrate is clear at room temperature.

Upon cooling of the concentrate stability is provided down to a temperature of about 33° F. at which point crystal formation commences. However, upon reheating the concentrate to a temperature of about 50° F. in the presence of agitation, the crystalline precipitate redissolves restoring the concentrate to a clear, commercially acceptable solution.

EXAMPLE 3

An aqueous concentrate is prepared in accordance with the procedure as set forth in Example 1 by dissolving 200 g/l of zinc chloride in about ½ liter of water followed by the addition and dissolving of 180 g/l of ethylbenzene sulfonate sodium salt. Thereafter, 40 g/l of furfural acetone is added and dissolved in the presence of agitation. The resultant solution is diluted with additional water to a total volume of 1 liter. The aqueous concentrate solution is clear.

The stability of the concentrate is evidenced by enabling a cooling thereof to a temperature as low as about 36° F. before any evidence of crystal formation is observed. However, upon reheating the concentrate to about 50° F. in the presence of agitation, a clear, commercially acceptable solution is again obtained.

EXAMPLE 4

An aqueous concentrate is prepared in accordance with the procedure as described in Example 1 by dissolving 200 g/l of zinc chloride in about ½ liter of water followed by the addition of 200 g/l of butyl benzene sulfonate sodium salt which is dissolved. Thereafter, 50 g/l of cinnamaldehyde is added in the presence of agitation and dissolved. The resultant concentrate is diluted with water to provide a total volume of 1 liter. The resultant aqueous concentrate is clear.

The stability of the concentrate is evidenced by the fact that it can be cooled to about 35° F. before any crystal formation is observed. However, upon a reheating of the concentrate to a temperature of about 50° F., in the presence of agitation the precipitate redissolves providing a clear, commercially acceptable solution.

EXAMPLE 5

An aqueous concentrate is prepared in accordance with the procedure as described in Example 1 by dissolving 300 g/l of zinc chloride in about ½ liter of water followed by the addition and dissolution of 135 g/l of isopropyl benzene sulfonate ammonium salt. Thereafter, 27 g/l of anisaldehyde is added in the presence of agitation and dissolved. The resultant concentrate is diluted with water to provide a total volume of 1 liter. The aqueous concentrate solution is clear.

The stability of the concentrate is evidenced by the fact that it can be cooled down to about 39° F. before any evidence of a crystalline precipitate is observed. However, upon reheating of the concentrate to about 50° F. in the presence of agitation, the crystals are redissolved and the concentrate is clear and commercially acceptable.

The foregoing examples substantiate the improved properties of the aqueous concentrates containing appreciable concentrations of the hydrophobic organic primary zinc plating brighteners. The relatively low temperature to which such concentrates can be subjected to before any precipitation occurs substantially increases the flexibility of shipment and storage. Of equal importance is the fact that even when such concentrates are subject to relatively low temperatures causing precipitation or "freezing-out" of the organic brightening agent, the concentrate can readily be restored to a clear solution by simply reheating to room temperature in the presence of agitation.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous concentrate adapted for dilution with water for use in the make-up and replenishment of zinc or zinc alloy plating baths of the chloride and mixed chloride types comprising an aqueous solution containing zinc chloride present in an amount of about 10 to about 400 g/l, a hydrophobic organic brightening agent selected from the group consisting of aryl aldehydes, halo aryl aldehydes, aryl alkenyl ketones, aryl alkenyl aldehydes, heterocyclic alkenyl ketones, heterocyclic alkenyl aldehydes and mixtures thereof present in an amount of about 10 to about 200 g/l, and a solubilizing agent comprising an alkyl phenyl sulfonate compound, said solubilizing agent present in an amount of at least about 10 g/l up to an amount in combination with said zinc chloride of about 270 g/l to about 570 g/l for each 100 g/l or fraction thereof of said brightening agent present in said concentrate.

2. The concentrate as defined in claim 1 containing about 100 to about 200 g/l zinc chloride.

3. The concentrate as defined in claim 1 containing about 150 g/l zinc chloride.

4. The concentrate as defined in claim 1 containing about 75 to about 100 g/l of said hydrophobic brightening agent.

5. The concentrate as defined in claim 1 containing about 100 to about 200 g/l zinc chloride and about 75 to about 100 g/l of said hydrophobic brightening agent.

6. The concentrate as defined in claim 1 in which said hydrophobic organic brightening agent is selected from the group consisting of benzylidene acetone, cinnamaldehyde, 4-phenyl-3-butyne-2-one, benzaldehyde, orthochlorobenzaldehyde, orthobromobenzaldehyd difluorobenzaldehyde, furfural acetone, 1-(3-pyridyl)- buten-3-one, anisaldehyde, vanillin, piperonal, 1-phen hexa-1,3-diene-5-one, 1-thiophene 2-buten-3-one, an mixtures thereof.

7. The concentrate as defined in claim 1 in which sai solubilizing agent comprises a bath soluble alkyl phen sulfonate compound selected from the class in whic the sulfonate group is connected directly to the phen ring and can contain one or two sulfonate groups an the alkyl group can contain from 1 up to 6 carbon atom and can contain from 1 up to 3 alkyl groups on th phenyl ring.

8. The solubilizing agent as defined in claim 7 con prising an alkyl phenyl sulfonate selected from th group consisting of isopropyl benzene sulfonate, cu mene sulfonate, ethylbenzene sulfonate, butyl benzen sulfonate, isopropyl benzene sulfonate, as well as th bath soluble and compatible salts and mixtures thereo

* * * * *